US005427498A

United States Patent [19]

Lehe et al.

[11] Patent Number: 5,427,498

[45] Date of Patent: Jun. 27, 1995

[54] HIGH PERFORMANCE CENTRIFUGAL PUMP HAVING AN OPEN-FACED IMPELLER

[75] Inventors: Jean-Robert Lehe, Vernon; André Beaurain, Chambly; René Bosson, Vernon; Etienne Tiret, La Chapelle Reanville, all of France

[73] Assignee: Societe Europeenne de Propulsion, Suresnes, France

[21] Appl. No.: 157,746

[22] Filed: Nov. 24, 1993

[30] Foreign Application Priority Data

Nov. 30, 1992 [FR] France ..... 92 14388

[51] Int. Cl.[6] ..... F04D 29/40

[52] U.S. Cl. ..... 415/58.2; 415/58.3; 415/58.4; 415/59.1; 415/106; 415/172.1; 415/173.3

[58] Field of Search ..... 415/58.1, 58.2, 58.3, 415/58.4, 59.1, 106, 128, 172.1, 173.1, 173.3

[56] References Cited

U.S. PATENT DOCUMENTS

| | | | |
|---|---|---|---|
| 1,385,115 | 7/1921 | Cone . | |
| 1,488,931 | 4/1924 | Marechal . | |
| 4,264,271 | 4/1981 | Libertini | 415/172.1 |
| 4,687,412 | 8/1987 | Chamberlain | 415/173.1 |

FOREIGN PATENT DOCUMENTS

| | | | |
|---|---|---|---|
| 0374020 | 6/1990 | European Pat. Off. . | |
| 723344 | 4/1932 | France . | |
| 1366715 | 1/1988 | U.S.S.R. | 415/58.2 |

OTHER PUBLICATIONS

"Centrifugal Pump With Semi-Open Impeller", Anop et al, Soviet Invention Illustrated, Sep. 1971, Derwent Publications Ltd. London, G.B. p. 24.

*Primary Examiner*—Edward K. Look
*Assistant Examiner*—James A. Larson
*Attorney, Agent, or Firm*—Weingarten, Schurgin, Gagnebin & Hayes

[57] ABSTRACT

The centrifugal pump with an open-faced impeller comprises at least one open-faced impeller having blades placed inside a casing defining both a delivery pipe and a suction pipe facing the base of the blades situated in the vicinity of a central shaft for driving the impeller. An active axial balancing system for the rotary assembly is integrated in the impeller and comprises a balancing chamber interposed between the rear face of the body of the impeller and an outer rear portion of the casing, the impeller itself acting as the balancing turntable. A shroud-forming intermediate part is prevented from rotating relative to the casing and is interposed between an outer front portion of the casing and the impeller, a cavity is formed between the outer front portion of the casing and the intermediate part to receive a back pressure of predetermined value serving, in operation, to maintain small clearance without contact between the intermediate part that is prevented from rotating and the blades of the impeller.

29 Claims, 13 Drawing Sheets

Fig_19
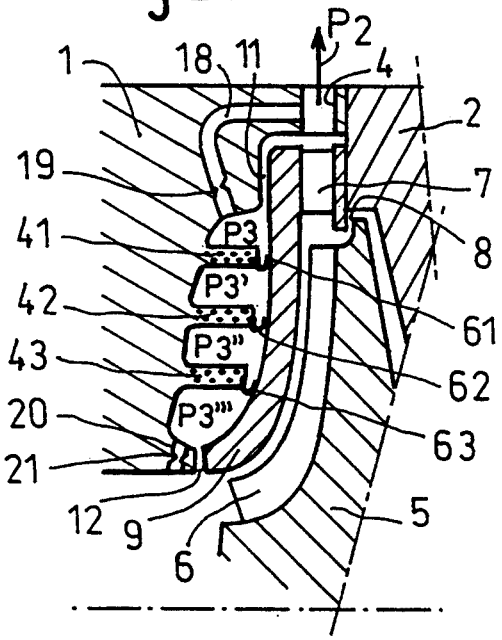
Fig_20
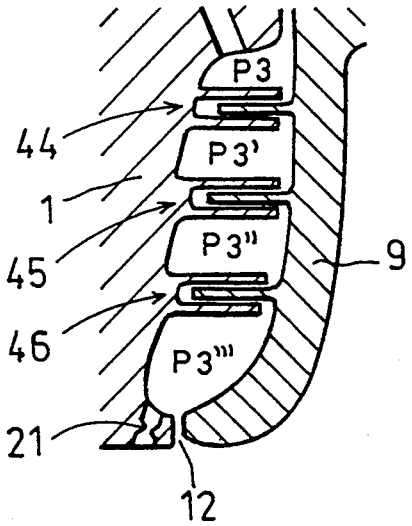
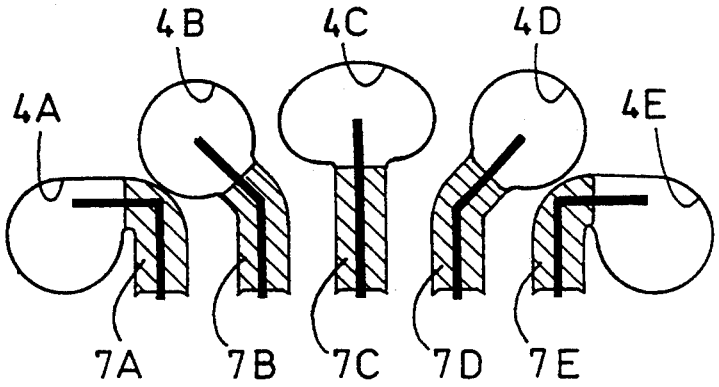
Fig_21
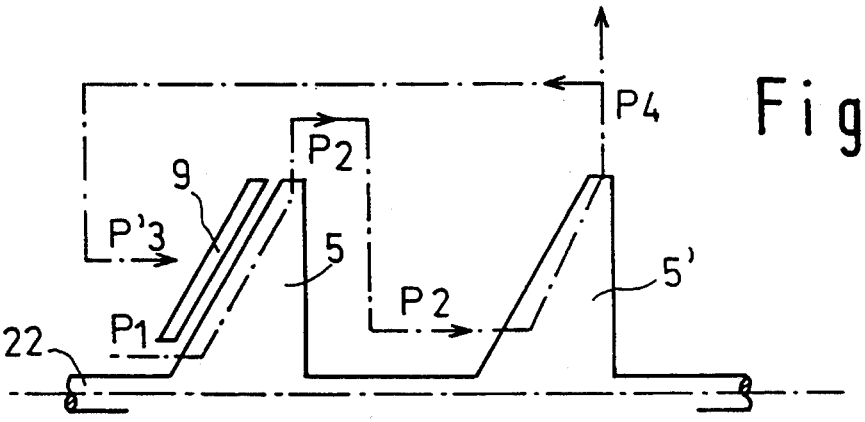
Fig_22

Ns = Specific speed

HIGH PERFORMANCE CENTRIFUGAL PUMP HAVING AN OPEN-FACED IMPELLER

FIELD OF THE INVENTION

The present invention relates to a high performance centrifugal pump having an open-faced impeller and usable not only in industrial applications, but also in the context of turbopumps for rocket engines.

PRIOR ART

The turbopumps of rocket engines fitted to the first stage of a launcher are high power pumps and they are characterized by large flow rates at pressures that are medium or high.

In existing embodiments of such high power turbopumps, the impellers of all centrifugal pump stages are provided with shrouds secured to the impellers, thus defining high efficiency shrouded impeller pumps that benefit from a large amount of tolerance in the axial position of the impeller, but in which peripheral speed is limited by the mechanical strength of the shroud. The use of shrouded impellers leads to the number of pump stages being increased to obtain a given rise in pressure, and consequently significantly increases costs. Further, it is relatively difficult to machine shrouded impellers, and this contributes to making this type of pump even more expensive.

Proposals have already been made to implement centrifugal pump stages using open-faced impellers, i.e. impellers that do not have a shroud secured to the front portions of the blades. It is easier to machine open-faced impellers, however such impellers imply impeller clearance between the front portions of the blades of the impeller and the front portion of the pump casing, which clearance leads to leakage, thereby reducing volumetric efficiency. To maintain an acceptable value for this efficiency, either the axial position of the impeller is set very accurately relative to bearings, thereby giving rise to high costs when not completely impossible, or else a large amount of impeller clearance is accepted, which is applicable only to low power pumps or to pumps that are relatively insensitive to this parameter, as are pumps having high specific speed, i.e. mixed-flow pumps.

The axial balancing system of centrifugal pumps, regardless of whether the impellers are shrouded or not, is either a passive system, e.g. a lubricated smooth abutment or a ball bearing with an oblique contact surface, or else it is an active system having a balancing turntable.

Both kinds of system, and in particular the passive system, give rise to long sequences of design dimensions, some of which are large, and they also give rise to elastic deformations that can be predetermined only very approximately. This gives rise to adjustments, disassemblies, readjustments, and reassemblies, that are still not always capable of achieving the desired result.

FIG. 27 shows another high power turbopump of the prior art having open-faced impellers, which pump was designed for fitting to the "XLR 129" engine that was developed by the firm PRATT & WHITNEY.

In such a turbopump, the central shaft 122, driven at its rear end by a first turbine stage 132 and by a second turbine stage 133, has an inducer 131 at its front end, followed by a first stage open-faced impeller 105 and by a second stage open-faced impeller 155 mounted back-to-back in opposition on bearings 123 and 124. The impellers 105 and 155 carry blades 106 and 156 which are not provided with an outer shroud and they are positioned directly facing the thick walls of a casing 101, 102. Axial balancing is provided by a separate balancing piston 160 which constitutes an active force regulator, the shaft 122 being free to move axially and taking up a position such that the sum of the axial forces is zero. Because of the presence of a separate balancing piston, accurate control of the clearances between the open-faced impellers and the corresponding faces of the casing is difficult, and fluid leakage losses can be large, thereby making it impossible to obtain high volumetric efficiency.

OBJECTS AND BRIEF SUMMARY OF THE INVENTION

The present invention seeks to provide a high performance centrifugal pump with an open-faced impeller that operates with high pressure rises and with large flow rates, while simultaneously being simple to manufacture, capable of reducing the number of pump stages required for a given pressure rise, given that it makes very high peripheral speeds possible, and having leakage losses that are limited so as to obtain higher volumetric efficiency than is obtained with known centrifugal pumps having open-faced impellers.

The invention also seeks to provide a centrifugal pump having an open-faced impeller that is usable both in industrial applications and in the context of high power turbopumps such as those which are used in a rocket engine for the first stage of a launcher.

These objects are achieved by means of a centrifugal pump having an open-faced impeller conveying a working liquid, the pump comprising at least one open-faced impeller fitted with blades placed inside a casing defining a suction pipe facing the base of the blades situated in the vicinity of a central shaft for driving the impeller and forming a portion of a rotary assembly, and a delivery pipe fitted with a fixed diffuser disposed facing the peripheral ends of the blades, and further comprising:

a) an active axial balancing system for the rotary assembly, which balancing system is integrated in the impeller and comprises a balancing chamber interposed between the rear face of the body of the impeller and an outer rear portion of the casing, said balancing chamber communicating with said delivery pump via a first nozzle whose axial clearance is maintained so as to be unvarying in operation and which is defined by the peripheral end of the impeller itself acting as a balancing turntable, and a nozzle piece secured to said outer rear portion of the casing and interposed between said diffuser and said peripheral end of the impeller, said balancing chamber communicating directly or indirectly with the suction pipe of the pump via a second nozzle, and b) a shroud-forming intermediate part prevented from rotating relative to the casing, interposed between the outer front portion of the casing and the impeller, the portion thereof facing the blades of the impeller having a certain capacity for displacement or for deformation in a direction parallel to the axis of the pump, a cavity being provided between said outer front portion of the casing and said intermediate part to receive a back pressure of predetermined value enabling small clearance without contact to be maintained in operation between said intermediate part that is prevented from rotating and the blades of the impeller that is rotated, regardless of any deformations of the outer front portion of the casing.

Thus, in accordance with the invention, the axial balancing system of the rotor that includes the open-faced impeller is of the active type and is integrated in the impeller which therefore acts as its own balancing piston. As a result, an accurate axial reference is available in the immediate vicinity of the tips of the blades of the impeller.

According to the invention, the parts are organized so that the clearance between the impeller and the member facing it, constituted by a non-rotating intermediate part that is separate from the bulk of the casing, is defined by a small number of design dimensions, and above all is capable of being optimized in the working position in such a manner as to be as small as possible while avoiding any risk of friction between the blades and the intermediate part.

Leakage losses can thus be kept very small in a centrifugal pump of the invention because the clearance between the non-rotary intermediate part forming a shroud and the open-faced impeller is controlled firstly by positioning the peripheral regions of the impeller and the intermediate part relative to the active faces of the upper nozzle of the axial balancing system which has clearance that is very accurate, using a sequence of design dimensions that is reduced to a minimum, and secondly by maintaining constant clearance between the impeller and the intermediate part by decoupling said intermediate part or by acting on the deformations of said part under the effect of the pressures that are exerted thereon.

Advantageously, the centrifugal pump of the invention includes means enabling a small flow of liquid to circulate through said cavity, from the delivery pipe to the suction pipe.

This small flow rate is one of the elements that make it possible to control the back pressure cheaply.

Firstly it avoids the risk that would be associated with a single pressurizing duct of transmitting only a fraction of the desired pressure to the cavity. Secondly it avoids vaporization phenomena within said cavity.

According to an important aspect of the present invention, the clearance J (best seen in FIGS. 23–26) between the impeller and the intermediate part is determined by a sequence of design dimensions limited to the combination of a design dimension J1 defined between said radial nozzle piece and the wall of the intermediate part facing the blades, a design dimension J12 defined between said nozzle piece and the peripheral end of the impeller, and a design dimension J13 defined between said peripheral end of the impeller and the front face of the impeller.

The sequence of design dimensions is thus limited to three accurate design dimensions, whereas prior art implementations implied either the use of a sequence of eight accurate design dimensions, or else the constraint of adjusting the result of such a sequence of design dimensions by tailor-making a wedge for adjusting the thickness of the impeller.

The invention may be embodied in numerous different ways.

Thus, various different particular embodiments are possible concerning the production and application of the back pressure.

The pump may comprise means for applying back pressure in the cavity by means of an additional liquid different from the working liquid conveyed by the pump, but of a chemical composition that is compatible with that of the working liquid.

In another embodiment, the pump includes means for applying back pressure in the cavity by means of the working fluid conveyed by the pump.

The pump may include a specific circuit passing through the casing to feed the cavity with liquid for the purpose of exerting said back pressure.

The specific circuit may be formed by ducts connected to a circuit external to the pump or by ducts connected respectively to the delivery pipe and to the suction pipe of the pump.

The low flow rate of fluid through the cavity can be obtained either directly by the dimensions of the ducts in the specific circuit, or else by incorporating calibrated orifices therein.

The centrifugal pump may be constituted by a multistage pump comprising a plurality of stages. In which case, at least one stage comprises said open-faced impeller, integrating an active axial balancing system and co-operating with the shroud-forming intermediate part that is prevented from rotating relative to the casing.

Advantageously, in this context, the means for applying back pressure in the cavity comprise means for taking working liquid from a stage situated downstream from the stage that includes the open-faced impeller and reinjection means for injecting the working liquid as taken into the cavity.

Back pressure is thus available that is greater than the outlet pressure of the first stage, thus making it possible, in particular, to reduce the size of the cavity.

In another particular embodiment of the invention, the means for applying back pressure in the cavity comprise means for direct communication with the delivery pipe and with the suction pipe.

The direct communication means may comprise passages of a size that is suitable for defining a low fluid flow rate.

The back pressure exerted in the cavity is servo-controlled to the clearance of the impeller.

A first way of producing the back pressure applied in the cavity is to obtain the back pressure by direct take-off from a volute associated with the delivery pipe and at a pressure that is close to that of the outlet pressure.

Another way of obtaining the back pressure which is applied in the cavity situated between the front portion of the casing and the intermediate part is to take off pressure from a volute associated with the delivery pipe and pass it through an expansion channel so as to obtain a pressure that is substantially less than the outlet pressure.

Another way of obtaining the back pressure applied in said cavity situated between the front portion of the casing and the intermediate part is to servo-control the back pressure to the outlet pressure in the delivery pipe so as to obtain a pressure that is greater than said outlet pressure.

In a first possible embodiment, the back pressure is applied by means of a fluid that is inserted into the cavity situated between the front portion of the casing and the intermediate part so as to exert back pressure of substantially constant value on the entire intermediate part.

Under such circumstances, said cavity communicates with the delivery and suction pipes respectively by means of an inlet duct and by means of an outlet duct, the ducts having head losses that are predetermined as a function of the desired low flow rate, of the area of the intermediate part subject to the back pressure, and of the springs acting on said intermediate part in certain embodiments. According to a particular characteristic of the invention, the inlet and outlet ducts include calibrated orifices.

In a second possible embodiment, the cavity situated between the front portion of the casing and the intermediate part includes a series of obstacles creating head losses, such that a fluid taken directly or indirectly from the delivery pipe flows behind the intermediate part towards the suction pipe at a very low flow rate and with a back pressure gradient similar to the pressure gradient that exists between the intermediate part and the impeller between the delivery pipe and the suction pipe.

The obstacles that give rise to head losses in the cavities may be constituted, by example, by porous partitions, or by baffles, or else by partitions provided with a plurality of calibrated orifices.

When back pressure of substantially constant value is applied in association with a determined operating point, various different particular embodiments are possible.

In one particular embodiment, the intermediate part is flexible with predetermined stiffness and is rigidly fixed to the casing in the vicinity of the suction pipe and also in the vicinity of the delivery pipe.

In another particular embodiment, the intermediate part is semi-rigid and is mounted so as to be free relative to the casing in the vicinity of the suction pipe, with a sealing gasket being interposed between said intermediate part and said casing in the vicinity of said suction pipe.

In either case, the intermediate part and the stationary diffuser may be constituted by a single part, or else the intermediate part may be fixed directly to the diffuser, which is itself mounted in stationary manner on the casing.

In yet another particular embodiment, the intermediate pump is constituted by a rigid piece mounted in such a manner as to be capable of moving slightly relative to the outer front portion of the casing under the effect of the back pressure applied in the cavity while being prevented from rotating relative to said outer portion of the casing, sealing gaskets being interposed between said rigid intermediate part and the casing in the vicinity of the suction pipe and of the delivery pipe.

In which case, the pump may include a resilient bellows of predetermined stiffness interposed between the front portion of the casing and the intermediate part in the vicinity of the delivery pipe both to provide sealing between the front portion of the casing and the intermediate part and to exert a thrust force on the intermediate part towards the diffuser.

In a variant embodiment, the pump includes a rubbing sealing gasket between the front portion of the casing and the intermediate part in the vicinity of the delivery pipe.

The rigid intermediate part may be held pressed against the stationary diffuser under drive from a spring, and under drive from the back pressure applied in said cavity.

With an intermediate part that is rigid or semi-rigid, the pump may include a resilient bellows of predetermined stiffness interposed between the front portion of the casing and the intermediate part in the vicinity of the suction pipe both to provide sealing and to hold the intermediate part off the impeller when at rest.

Alternatively, the pump may include a rubbing sealing gasket suitable to withstand such friction between the front portion of the casing and the intermediate part in the vicinity of the suction pipe.

In which case, the pump may also include a spring of predetermined stiffness interposed between the intermediate part and the casing, in the vicinity of the suction pipe, in order to keep the intermediate part off the impeller at rest.

The spring may comprise a set of "Belleville" spring washers providing predetermined low stiffness, or it may comprise a ribbed washer presenting predetermined high stiffness.

In a pump with a rigid intermediate part, and if a value of back pressure has been selected that is greater than the pressure exerted by the impeller, then in a particular embodiment of the invention, the intermediate part may co-operate with an abutment secured to the front portion of the casing which limits the stroke of the intermediate part towards the impeller in the vicinity of the suction pipe.

BRIEF DESCRIPTION OF THE DRAWINGS

Other characteristics and advantages of the invention appear from the following description of particular embodiments of the invention, given as non-limiting examples, and with reference to the accompanying drawings, in which:

FIGS. 19, 19A, and 20 show three variant embodiments of the invention in which obstacles for generating head losses are disposed in the cavity formed between the casing of the pump and the intermediate part;

FIG. 21 is a diagram showing five possible configurations for the diffuser integrated in the pump of the invention;

FIG. 22 is a diagram showing how a first open-faced impeller present in a first stage of a multistage centrifugal pump of the invention can be associated with a second impeller present in a second pump stage, with the fluid that exerts back pressure being taken from the second stage;

DETAILED DESCRIPTION OF PARTICULAR EMBODIMENTS

Figure 1:
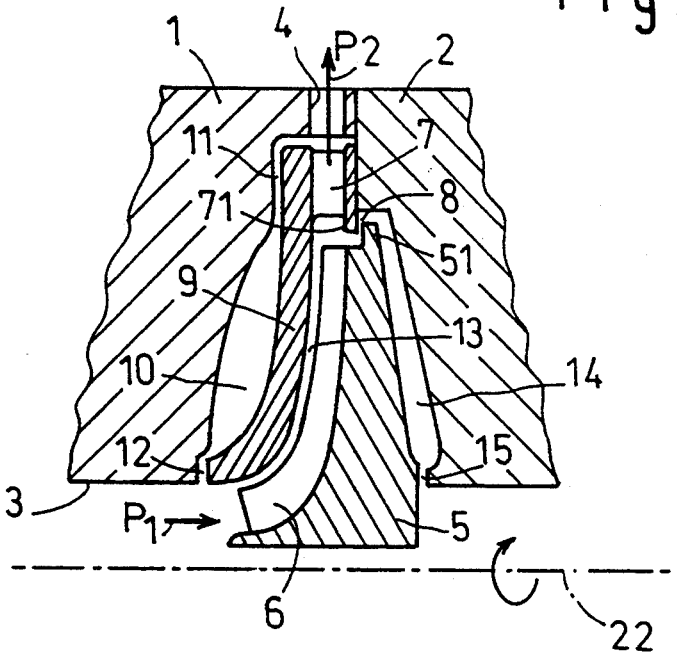
FIG. 1 is an axial half-section view showing an open-faced impeller co-operating with an intermediate part complying with a first general embodiment of a centrifugal pump of the present invention.

With reference to FIG. 1 and to FIGS. 23 to 26, the description begins with the general structure of a centrifugal pump having an open-faced impeller, in accordance with the invention.

The impeller 5 comprises a body having blades 6 mounted on its front face and is rotated by a central shaft 22 inside a casing 1, 2 that comprises a front portion 1 and a rear portion 2. A suction pipe 3 is provided at the front portion 1 of the casing in the vicinity of the central shaft 22 for bringing a fluid at a pressure P1 into contact with the blades 6 of the impeller 5. A diffuser 7 mounted on the rear portion 2 of the casing and extended by a delivery pipe 4 is disposed around the peripheral portion of the blades 6 of the impeller 5 for evacuating the fluid at a delivery pressure P2 greater than the suction pressure P1 via a manifold in the form of a volute or a torus (not shown in FIG. 1).

In accordance with the invention, the impeller 5 is of the open-faced type, i.e. it does not have a shroud mounted on its front face, and an active axial balancing system for the entire rotating assembly makes use of the rear portion of the impeller 5 as a balancing turntable. Thus, a nozzle 8 defining clearance J12 (FIG. 24) that does not vary in operation is implemented at the peripheral portion of the impeller between a piece 71 secured to the rear portion 2 of the casing, or of the diffuser 7, and a peripheral portion 51 of the body of the impeller 5 which takes up position behind the piece 71. The nozzle 8 provides communication for the fluid present at the inlet of the diffuser 7 to a chamber 14 situated behind the body of the impeller 5 and opening out at its end situated closest to the shaft 22 via a calibrated orifice 15.

An intermediate part 9 is interposed between the solid front portion 1 of the casing 1, 2 and the blades 6 of the impeller 5 so as to form a shroud that is prevented from rotating relative to the casing 1, 2 and that is situated facing the blades 6 over the entire length thereof, but without making contact therewith, thus defining a small amount of clearance 13 of value J between the intermediate part 9 and the blades 6.

A cavity 10 is provided between the front portion 1 of the casing and the intermediate part 9. A first calibrated passage 11 between the delivery pipe 4 and the cavity 10, and a second calibrated passage 12 between the cavity 10 and the suction pipe 3 serve to establish back pressure P3 inside the cavity 10 by causing fluid to pass at a small flow rate through the passages 11 and 12. In the general embodiment of FIG. 1, the back pressure P3 has a value that is less than or equal to the delivery pressure P2, however in certain particular embodiments, the back pressure P3 could, where appropriate, be greater than the delivery pressure P2, while nevertheless being capable of being servo-controlled thereto.

Because of the effect of the back pressure P3 present in the cavity 10, and taking account of the structure of the intermediate part 9 and of the way in which it is mounted, which part is capable of displacement or of deformation or of simultaneous displacement and deformation in the axial direction for the purpose of transmitting the back pressure to the chamber containing the impeller 5, while still being prevented from rotating relative to the casing 1, 2, it is possible under all circumstances to maintain small and constant clearance 13 in operation between the intermediate part 9 and the blades 6 of the impeller, regardless of the deformation to which the front portion 1 of the outer casing may be subjected.

Providing the clearance 13 remains small, a large pressure rise P2 can be obtained by using the open-faced impeller 5 in a single pump stage and without having a serious effect on the volumetric efficiency thereof.

In general, for given flow rate and pressure rise specifications, and for a given speed of rotation, it is necessary to reduce the ratio J/B of the clearance J between the impeller and the wall facing the blades 6 of the impeller divided by the width or depth B of the blades 6 of the impeller 5 at the periphery thereof to a value that enables acceptable performance to be ensured.

Insofar as the increase in the width B of the blades 6 at the outlet from the impeller is limited, in impellers 5 that give a large pressure rise, due to the need to ensure that the impeller is mechanically sound, and where casing deformation tends to increase the clearance J with increasing speed of rotation, known centrifugal pumps having open-faced impellers are incapable under viable economic conditions of achieving satisfactory performance with large pressure rises and at high flow rates as sought by the invention. In contrast, the invention makes it possible, even at high speeds of rotation, to obtain the desired performance in reproducible manner, with this being achieved by virtue of the presence of the intermediate part 9 between the outer casing and the pump impeller, which part is subjected to the back pressure P3 for the purpose of reducing the clearance J in operation.

Figure 28:
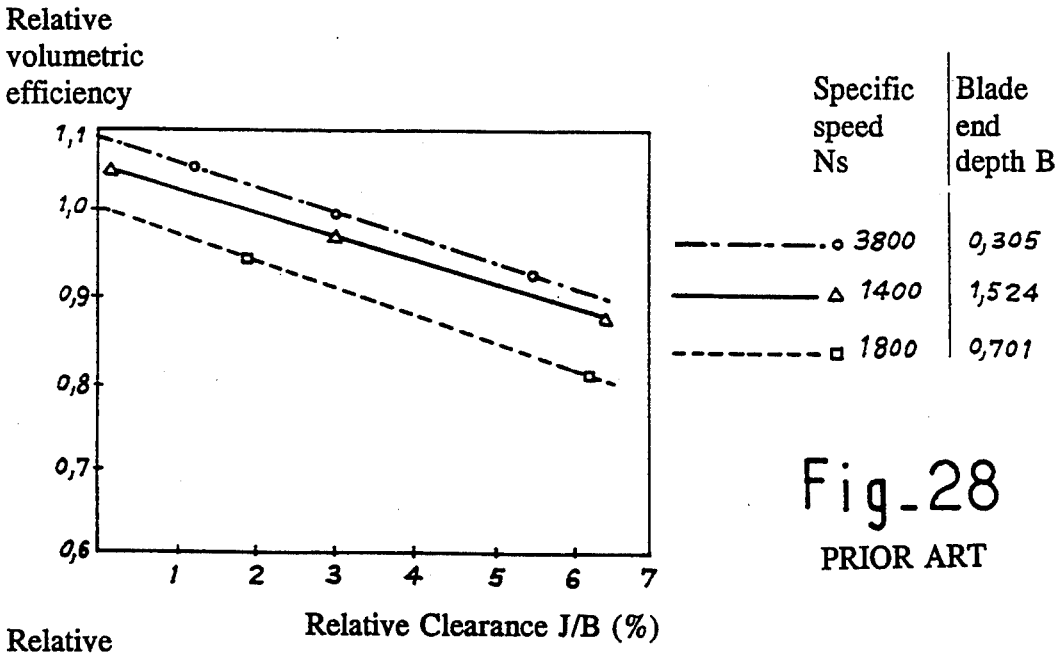
Fig 28 PRIOR ART
FIGS. 28 to 30 are known charts for different specific speeds, respectively showing relative volumetric efficiency as a function of relative clearance at the impeller, relative pressure rise as a function of the clearance at the impeller, and complementary volumetric efficiency as a function of flow rate, in all cases for centrifugal pumps.
Figure 29:
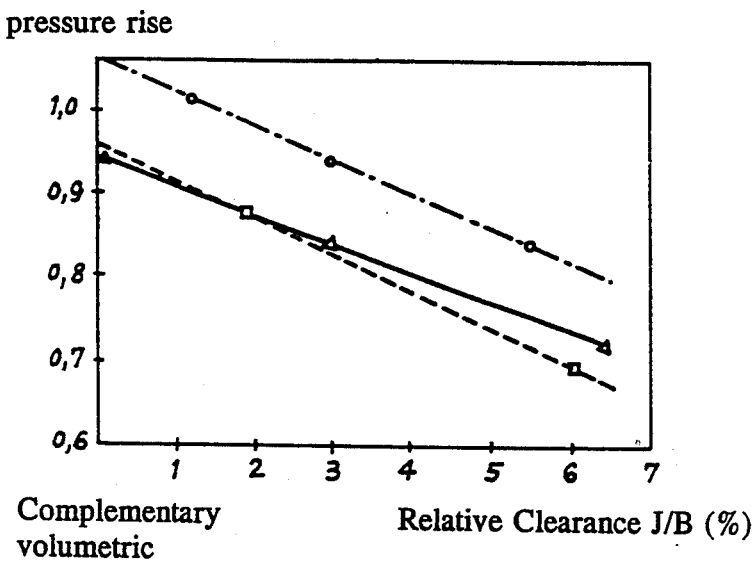
Fig 29 PRIOR ART
Figure 30:
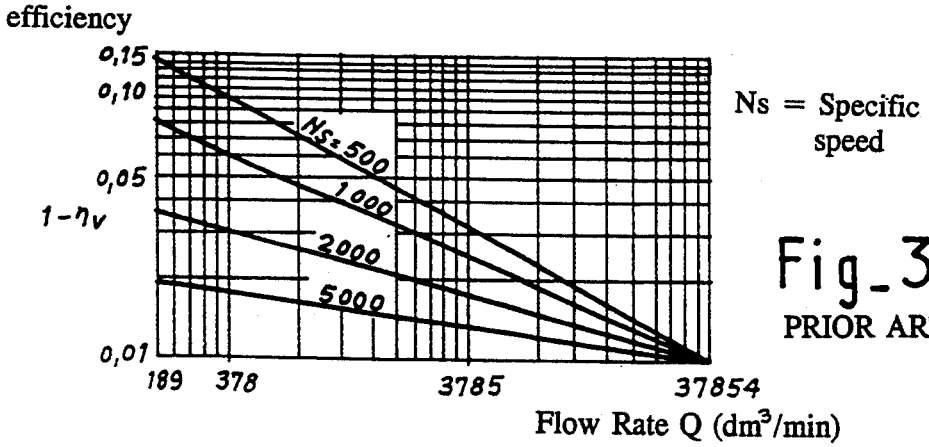
Fig 30 PRIOR ART

FIGS. 28 to 30 show three known charts applicable to a centrifugal pump and showing how volumetric efficiency and pressure rise are a function of the relative clearance J/B, of the specific speed, and of flow rate.

The charts of FIGS. 28 and 29 are taken from a NASA monograph entitled "Centrifugal flow turbopump", while the chart of FIG. 30 is taken from the work "Pump handbook" by I. J. KARASSIK, W. C. KURTZCH, W. H. FRAZER, and J. P. MESSINA, as published by the McGraw-Hill Book Company.

For three different specific speeds corresponding to different end depths of the impeller blades, the charts of FIGS. 28 and 29 respectively provide the relative volumetric efficiency and the relative pressure rise of a pump having an open-faced impeller compared with a pump having a shrouded impeller, as a function of the relative clearance J/B, where J is the clearance between the impeller and the wall facing the blades of the impeller, and B is the depth of the impeller blades at the periphery of the impeller.

For four different specific speeds $N_s$, the chart of FIG. 30 gives complementary volumetric efficiency $(1-\eta v)$ as a function of flow rate Q, the specific speeds $N_s$ being determined from the speed of rotation N of the impeller expressed in revolutions per minute (rpm), from the flow rate Q expressed in liters per minute, and from the depth B of the blades expressed in cm, by using the equation:

$$N_s=(0.514\ N\sqrt{Q})/(0.077\ B^{\frac{3}{4}})$$

It will be observed that the relationship between the expressions for specific speed $N_s$ given in the charts of FIGS. 28 and 30 and the non-dimensional specific speed given in the comparative table below is as follows:

$$N_s=(\text{non-dimensional specific speed})/2733$$

By way of example, the following tables provides performance values firstly for a pump made in conventional manner and secondly for a pump made in accordance with the invention, at typical values of pressure $P_0=250$ bar and flow rate $Q_0=50$ kg/s.

The following table makes it possible to observe the improvements provided by the invention in the value of the relative clearance J/B and in efficiency.

| Performance criterion | Pump satisfying ($P_o$, $Q_o$) Prior art | The invention |
|---|---|---|
| Relative clearance J/B | <6% | <2% |
| Specific speed | 0.25[1] | 0.25[1] |
| Pressure rise | $P_o$ = 250 bar | $P_o$ = 250 bar |
| Flow rate | $Q_o$ = 50 kg/s | $Q_o$ = 50 kg/s |
| Efficiency | 0.66 | 0.74 |

[1]Dimensionless number.

Figure 23:
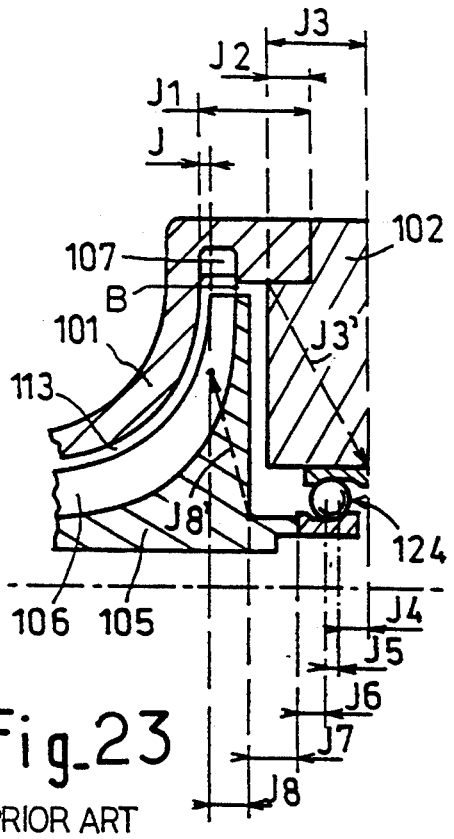
Fig 23 PRIOR ART
FIG. 23 is an axial half-section view of an open-faced impeller mounted in conventional manner, and showing the various design dimensions that contribute to defining the axial clearance of the impeller.

With reference more particularly to FIGS. 23 to 26, it can be seen that with the prior art pump having an open-faced impeller as shown in FIG. 23, where the open-faced impeller 105 fitted with blades 106 directly faces the front portion 101 of the casing 101, 102, and where axial forces are taken up by a ball bearing 124 interposed between the rear portion 102 of the casing 101, 102 and the shaft of the impeller 105, the clearance J between the blades 106 of the impeller 105 and the front portion 101 of the casing 101, 102 is determined by a vector sequence of eight design dimensions J1 to J8 of narrow tolerances, as shown in FIG. 23.

Figure 25:
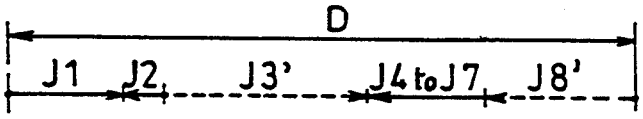
Fig 25 PRIOR ART
FIGS. 25 and 26 are comparative diagrams showing the accumulated distances of the various design dimensions that contribute to defining clearance in the conventional assembly of FIG. 23 and in the assembly of the invention as shown in FIG. 24.

FIG. 25 shows the sum D of the moduluses of the various vectors J1 to J8 corresponding to the various design dimensions that contribute to defining the clearance J in the prior art embodiment of FIG. 23 which does not make use of an axial balancing system integrated in the impeller nor does it make use of an intermediate part controlled by back pressure. The clearance J is poorly controlled because of the large number of design dimensions and thus of interfaces involved, and because the distance D is large. The tolerances on design dimensions J1 to J6 and on design dimensions J8 can be considerably increased by providing an adjustment wedge corresponding to design dimension J8. However that merely replaces one constraint with another.

Figure 24:
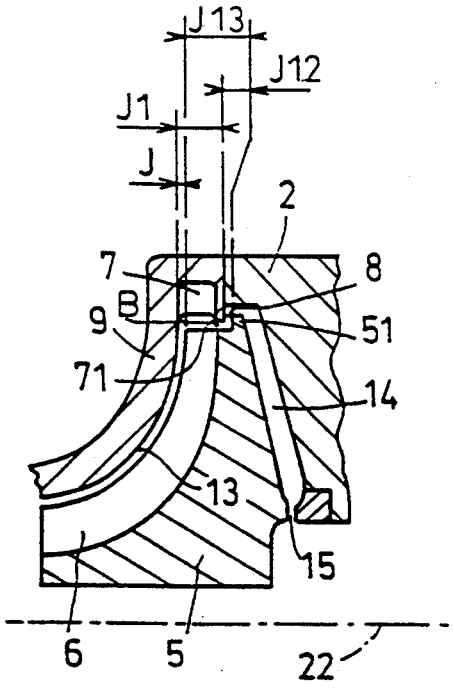
FIG. 24 is an axial half-section view of an open-faced impeller mounted in accordance with the invention, and showing the various design dimensions that contribute to defining the axial clearance of the impeller.
Figure 26:
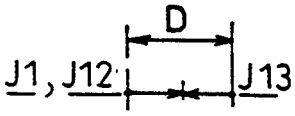
Figure 27:
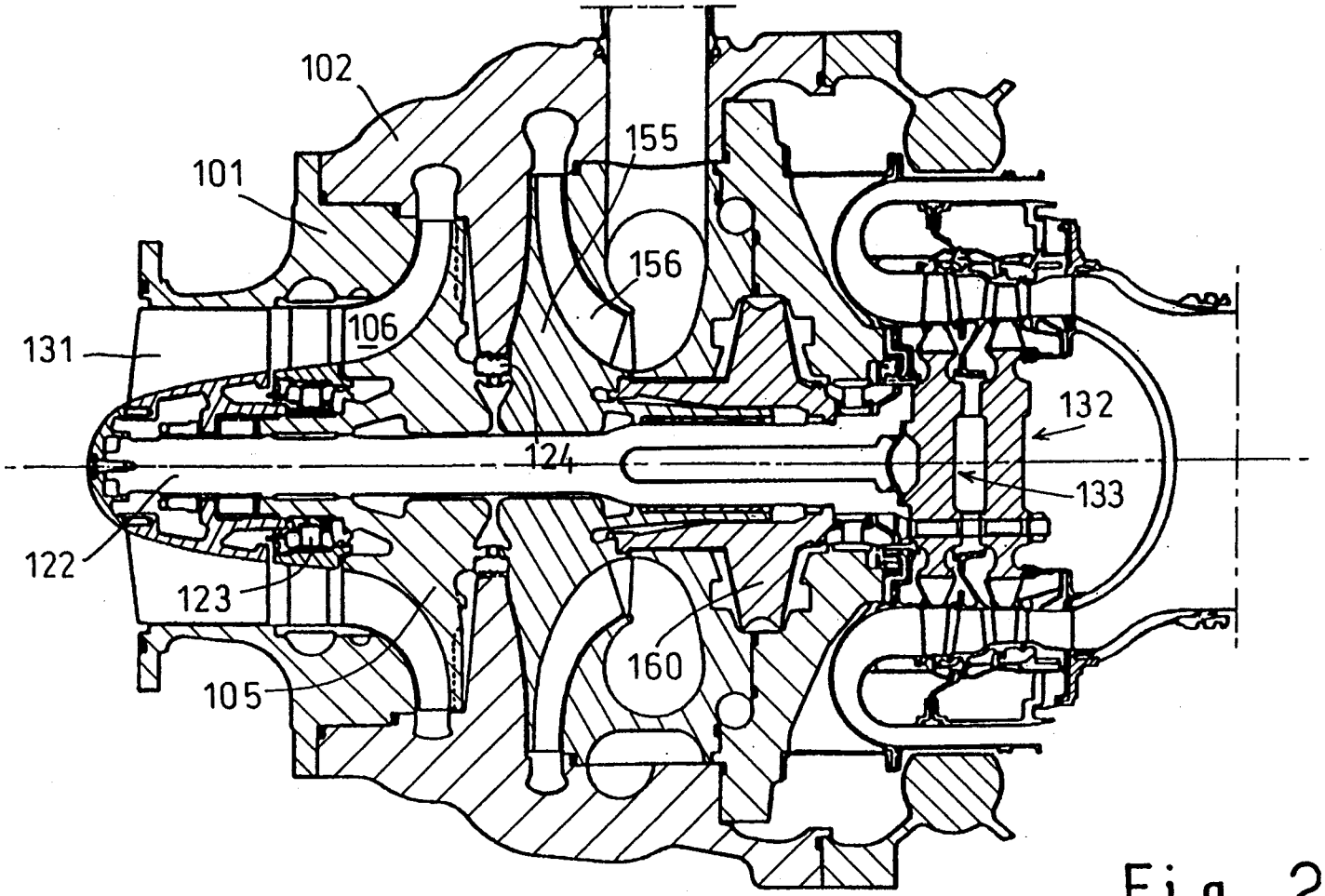
Fig 27 PRIOR ART
FIG. 27 is an axial section view through a prior art turbopump project that implements two open-faced impellers mounted back-to-back.

In contrast, FIG. 26 shows that in the context of the present invention, as shown in FIG. 24, the clearance J between the impeller 5 and the intermediate part 9 is determined by a small number of design dimensions J1, J12, and J13. Dimension J1 is defined between the radial projection 71 secured to the diffuser 7 and the wall of the intermediate part 9 facing the blades 6. Dimension J1 thus has a position which depends on pressure to a small extent. Dimension J12 is defined between the radial projection 71 secured to the diffuser 7 and the shoulder 51 provided at the peripheral portion of the impeller 5 and it constitutes clearance that does not vary in operation. The dimension J13 is defined between the shoulder 51 of the impeller 5 and the front face of the impeller 5. When the intermediate part 9 is not secured to the diffuser 7, only one additional design dimension J14, as shown in FIG. 7A, is added to the dimensions J1, J12, and J13. As can be seen in FIG. 26, the accumulated distance D between the attachment points of the vectors J1, J12, and J13 in three dimensions is very small, and the clearance J can be defined with maximum possible accuracy because of the existence of an accurate axial reference in the immediate vicinity of the tips of the blades 6 of the impeller 5, level with the nozzle 8.

In a centrifugal pump of the invention, as shown in FIG. 1, the intermediate part 9 may, when at rest, be at a distance from its working position, i.e. it may be remote from the impeller 5. As the pump speed rises, the back pressure P3 may be applied progressively in the cavity 10 behind the intermediate part 9 so that it moves into its working position at nominal speed.

The working position may be obtained merely by equilibrium between the pressure created by the impeller 5 and the back pressure P3. Under such circumstances, as in FIG. 1, there is no need to provide an abutment for limiting the stroke of the intermediate part 9 whose portion situated adjacent to the suction pipe 3 is free.

Figure 2:
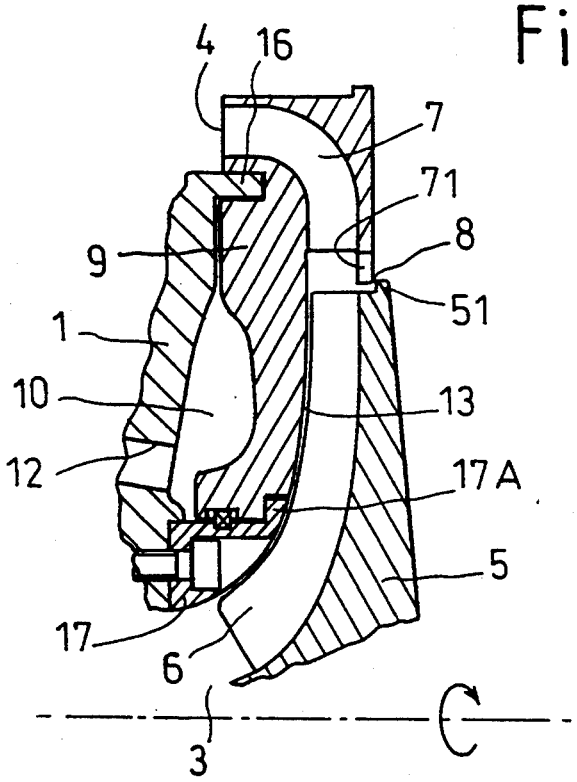
FIG. 2 is an axial half-section view showing an open-faced impeller co-operating with an intermediate part in accordance with a second general embodiment of the centrifugal pump of the present invention.

FIG. 2 shows a second general embodiment in which the intermediate part 9 co-operates with an element 16 of the front portion 1 of the casing that serves to prevent the part 9 rotating. (In this case, the part 9 is integral with the diffuser 7, but in other cases it need merely press against the diffuser 7.) The portion of the intermediate part 9 situated adjacent to the suction pipe 3 is free to move axially, but its stroke is limited by a part 17 which is secured to the front portion 1 of the casing and defines an abutment 17A (FIG. 2). The working position of the intermediate part 9 is thus defined by the abutment 17A situated adjacent to the suction pipe 3. The value of the back pressure P3 inside the cavity 10 is such that in the working position it ensures satisfactory contact between the intermediate part 9 and the abutment 17A.

In the embodiment illustrated in FIG. 2 the intermediate part 9, when at rest, need not be in contact with the abutment 17A. Under such circumstances, if a certain distance exists at rest between the intermediate part 9 and the abutment 17A, it is appropriate for the clearance between the impeller 5 and the intermediate part 9 to increase from the delivery pipe 4 to the abutment 17A so that at this point a value is obtained which is equal to said distance that exists between the intermediate part 9 and the abutment 17A.

In the embodiment of FIG. 1 as in the embodiment of FIG. 2, the working position achieves optimum clearance 13 between the impeller 5 and the intermediate part 9, i.e. the smallest possible clearance that does not run the risk of friction. The clearance depends on the tolerances to which the parts are made, on the extent to which they deform under the effect of pressures and centrifugal forces, and also, where appropriate, on relative thermal contraction or expansion. The thickness of the intermediate part 9 absorbs any differences that may exist between the pressure over the blades 6 and the back pressure P3 inside the cavity 10.

Various particular embodiments of the invention are described below with reference to FIGS. 3 to 22.

Figure 3:
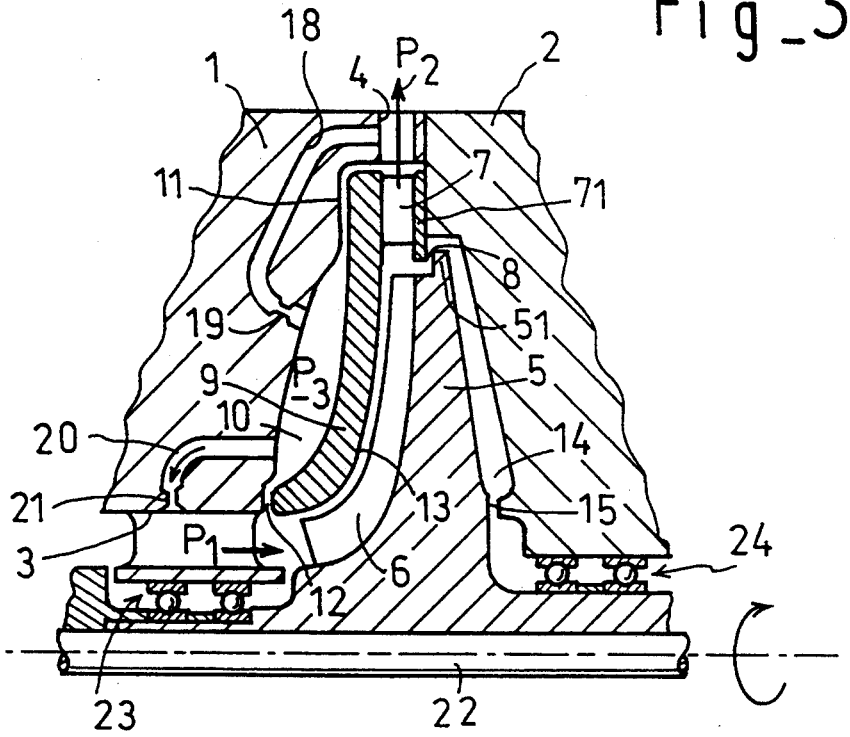
FIG. 3 shows a variant of the FIG. 1 embodiment, further showing the support for the impeller relative to the casing of the pump.

FIG. 3 relates to an embodiment analogous to that of FIG. 1, having a semi-rigid intermediate part 9 that co-operates with the diffuser 7 and the radially projecting piece 71 contributing to defining the nozzle 8 to constitute a single part connected to the rear portion 2 of the casing 1, 2 in the vicinity of the delivery pipe 4, whereas the other end of the intermediate part 9 situated adjacent to the suction pipe 3 is provided with the ability to move axially that is associated with its own elasticity under the effect of the back pressure P3. In FIG. 3, it can nevertheless be seen that the clearances 11 and 12 between the intermediate part 9 and the front portion 1 of the casing in the vicinity of the delivery pipe 4 and of the suction pipe 3 are small and that the cavity 10 in which a back pressure P3 is to be established is fed with fluid from the delivery pipe 4 essentially via a channel 18 formed through the front portion 1 of the casing and provided with a calibrated orifice 19. The fluid is itself evacuated from the cavity 10 via another channel 20 likewise provided with a calibrated orifice 21 and opening out into the suction pipe 3. Back pressure P3 of a value lying between the delivery pressure P2 and the suction pressure P1 can thus be established automatically and in controlled manner within the cavity 10.

In FIG. 3, the channels 18 and 20 are shown as being connected respectively to the delivery pipe 4 and to the suction pipe 3. Nevertheless, the channels 18 and 20 formed through the front portion 1 of the casing could equally well be connected to a circuit external to the pump, in order to apply the back pressure P3 using a small flow rate of fluid of a kind different from that of the working fluid of the pump, but having a chemical composition that is compatible with that of the working fluid.

The small fluid flow rate through the channels 18 and 20 may be obtained either directly by the dimensioning of the channels 18 and 20 or else by incorporating calibrated orifices 19 and 21 therein, as shown in FIG. 3.

Also in FIG. 3, there can be seen diagrammatic representations of ball bearings 23 and 24 supporting the shaft 22 of the impeller relative to the casing 1, 2, but having no function in taking up axial forces. To simplify the drawings, the bearings 23 and 24 are not shown in FIGS. 1, 2, 4 to 7, and 17 and 19.

Figure 4:
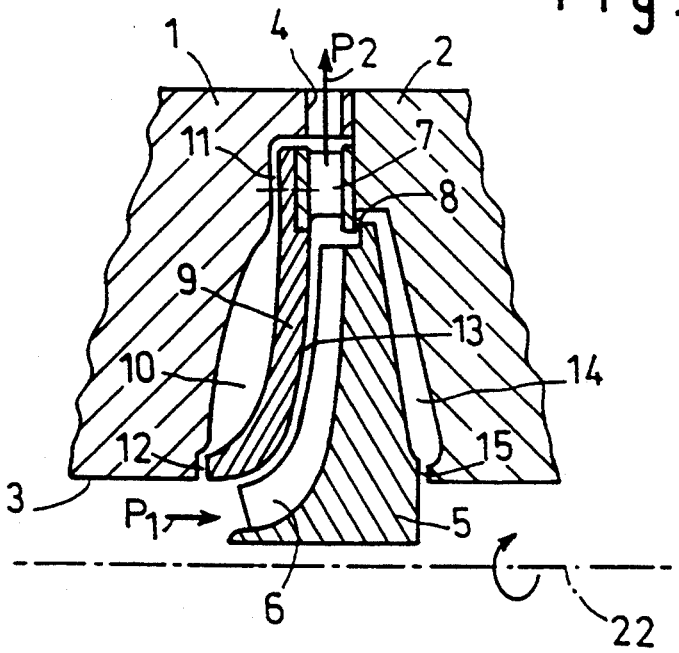
FIG. 4 shows another variant embodiment of FIG. 1.

FIG. 4 is likewise analogous to FIG. 1 and is therefore not described in detail. FIG. 4 differs from FIG. 1 in that the intermediate part 9 is fixed directly to the diffuser 7 adjacent to the delivery duct 4, whereas in FIG. 1, the intermediate part 9, the diffuser 7, and the radial projection 71 are integrated in a single piece.

Figure 5:
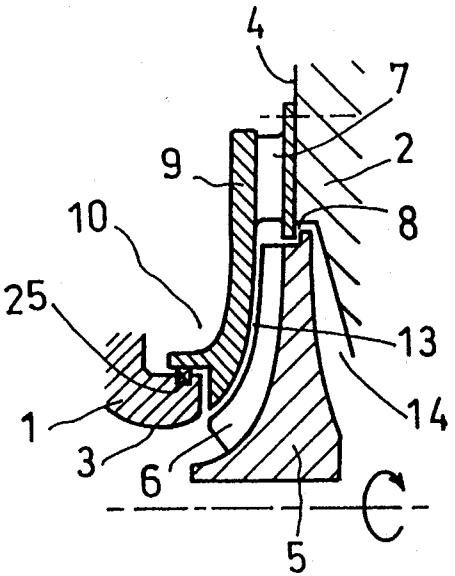

FIG. 5 shows an embodiment in which, as in FIGS. 1 and 3, the semi-rigid intermediate part 9 and the diffuser 7 (advantageously constituted as a single piece) are fixed rigidly to the portion 2 of the casing in the vicinity of the delivery pipe 4, whereas the portion of the intermediate part 9 situated in the vicinity of the suction pipe 3 is provided with the ability to move axially in association with its own elasticity. Nevertheless, FIG. 5 shows a sealing ring 25 disposed between the intermediate part 9 and the front portion 1 of the casing defining the suction pipe 3. Communication between the cavity 10 and the suction pipe of the pump is provided by a duct that is not shown. The stiffness of the intermediate part 9 may optionally vary radially.

Figure 6:
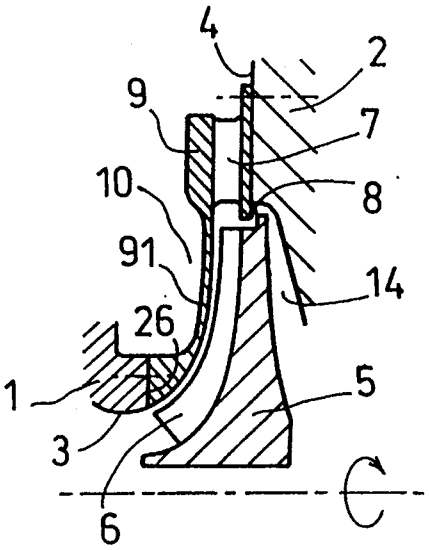

FIG. 6 shows an embodiment in which the intermediate part 9 includes a flexible rear portion 91 capable of deforming under the effect of the back pressure P3. The stiffness of the flexible portion 91 may optionally vary radially. Adjacent to the delivery pipe 4, the intermediate part 9 is fixed in rigid manner to the diffuser 7 which is itself rigidly fixed to the portion 2 of the casing. The intermediate part 9 and the diffuser 7 may advantageously constitute a single piece. Adjacent to the suction pipe 3, the part 9 is fixed rigidly by connection means 26 to the front portion 1 of the casing. Communication between the cavity 10 and the suction pipe of the pump is provided by a duct that is not shown.

Figure 7:
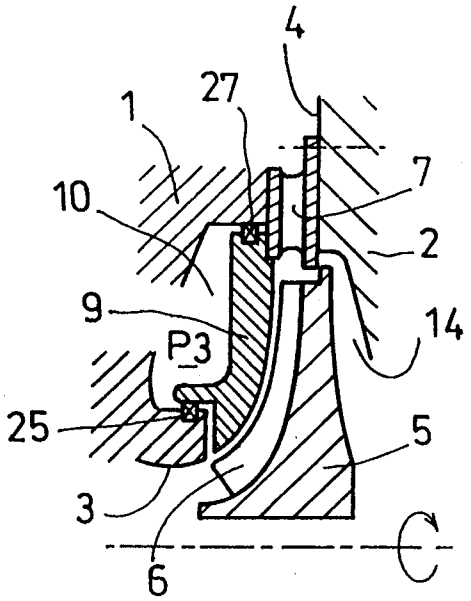
FIGS. 5 to 7 are axial half-section views of other embodiments of an open-faced impeller co-operating respectively with an intermediate part that is semi-rigid, an intermediate part that is flexible, and an intermediate part that is rigid.
Figure 7A:
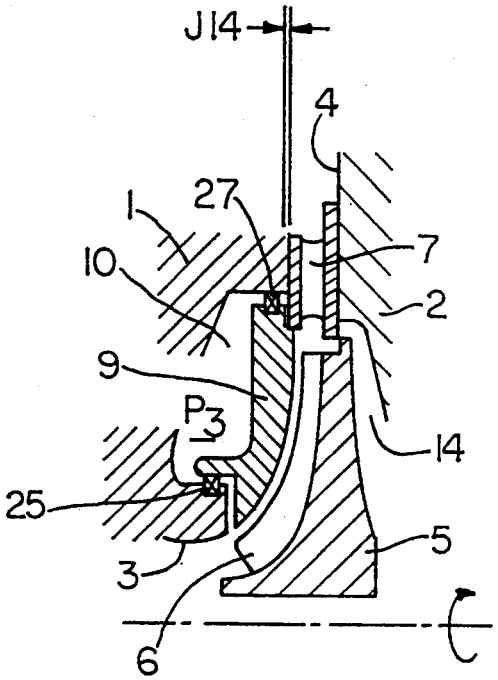
FIG. 7A shows the embodiment of FIG. 7 illustrating a further design dimension.

Like FIG. 2, FIG. 7 shows a rigid intermediate part 9 mounted as a piston, and rigidly secured neither to the casing 1, 2, nor to the stationary diffuser 7. In operation, the part 9 is pressed against the diffuser 7 by the back pressure P3 exerted inside the cavity 10. Sealing rings 25 and 27 provide sealing for the cavity 10 around the part 9 adjacent to the suction pipe 3 and to the delivery pipe 4. Communication between the cavity 10 and both the delivery pipe 4 and the suction pipe 3 of the pump is provided by ducts that are not shown. In the embodiment of FIG. 7, the intermediate part 9 is prevented from rotating by an antirotation system. The positioning of the intermediate part 9 pressed against the diffuser 7 may be achieved solely under drive from the back pressure P3 present in the cavity 10.

Figure 8:
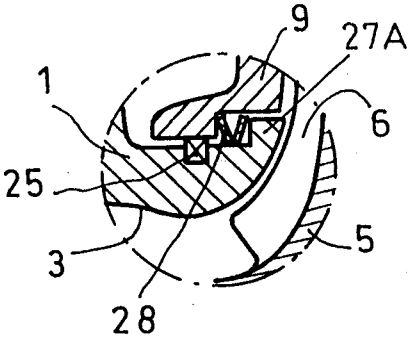
FIG. 8 shows a variant embodiment of the portion of the intermediate part shown in FIGS. 5 and 7 as is situated adjacent to the suction duct, with resilient return means being implemented.

FIG. 8 shows a variant applicable to the embodiments of FIGS. 5 and 7, in which, at rest, the intermediate part 9 adjacent to the suction pipe 3 is held away from the impeller 5 by a spring 28.

Depending on the required displacements and forces, the stiffness of this spring may be low or high.

Figure 9:
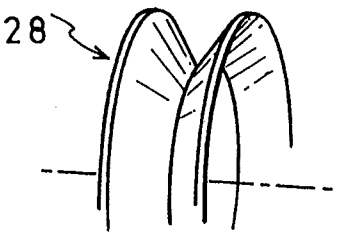

FIG. 9 shows a low stiffness spring 28 made up of two "Belleville" spring washers.

Figure 10:
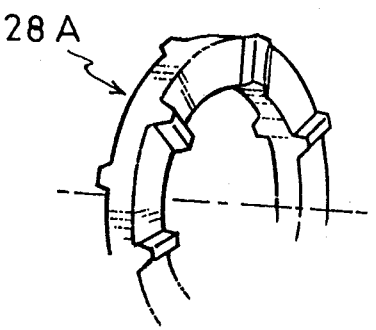
FIGS. 9 and 10 are fragmentary perspective views showing two examples of resilient return means suitable for use in the embodiment of FIG. 8.
Figure 11:
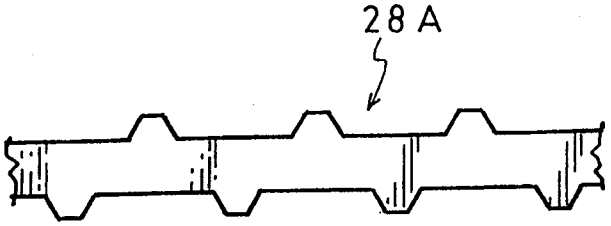
FIG. 11 shows a development of the ribbed washer as shown in FIG. 10.

FIG. 10 shows a ribbed washer 28A which constitutes a spring of high stiffness. FIG. 11 shows the developed profile of such an example of a high stiffness spring 28A.

Figure 12:
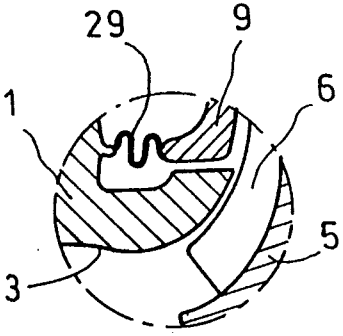
FIG. 12 shows another variant embodiment of the portion of the intermediate part of FIGS. 5 and 7 that is situated adjacent to the suction duct, together with a resilient bellows.

FIG. 12 shows a variant in which the sealing ring 25 and the spring 28 of FIG. 8 are combined in a single member constituted by a bellows 29 connecting the intermediate part 9 to the front portion 1 of the casing 1, 2 adjacent to the suction pipe 3. The bellows 29 thus performs the sealing function and also the function of holding off the part 9 at rest.

Figure 13:
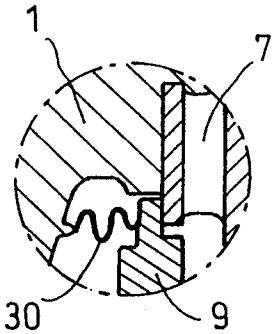
FIG. 13 shows a variant embodiment of the portion of the intermediate part of FIG. 7 situated adjacent to the delivery duct, together with a resilient bellows.

FIG. 13 shows a variant of the FIG. 7 embodiment in which sealing and the force that presses the intermediate part 9 against the diffuser 7 adjacent to the delivery pipe 4 are both performed by a bellows 30.

Figure 14:
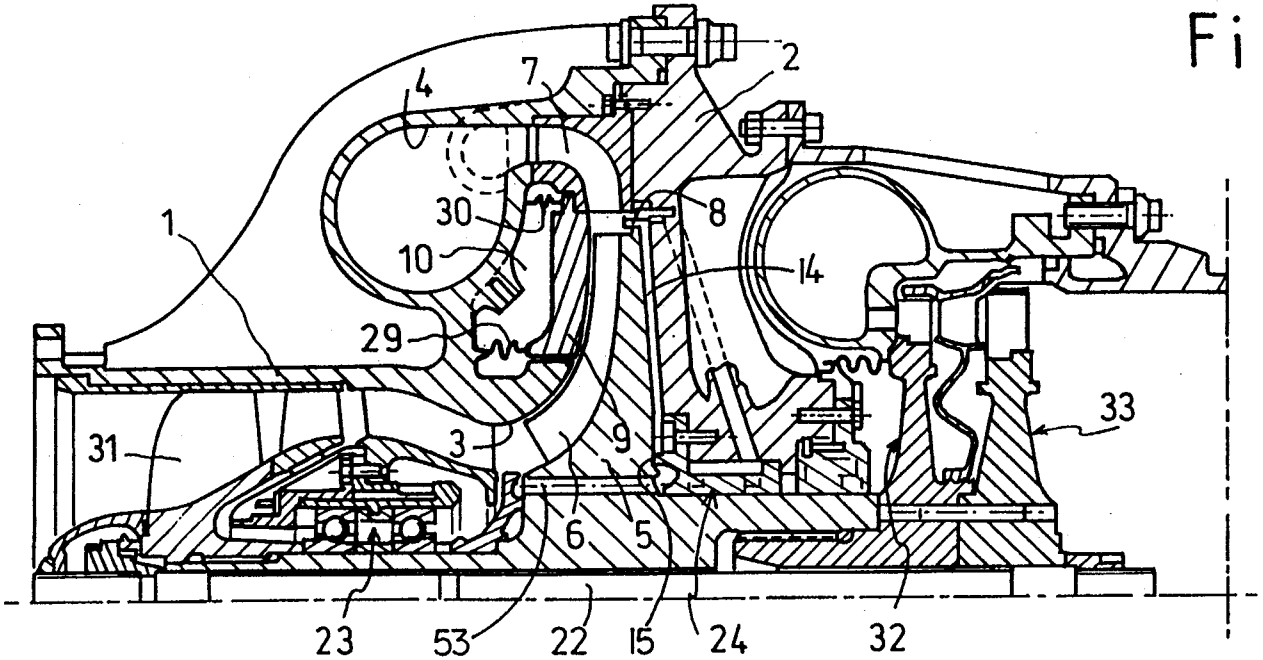
FIG. 14 is an axial half-section view showing the general structure of a centrifugal pump having an open-faced impeller in accordance with the invention, in which a rigid intermediate part is mounted as a piston cooperating with two resilient belows.

By way of example, FIG. 14 shows a variant combining FIGS. 7, 12, and 13 within a turbopump that has two turbine stages 32 and 33, an inducer 31, and two bearings 23 and 24 supporting the shaft 22 of an open-faced impeller 5 that co-operates with an intermediate part 9 of the invention. Communication between the chamber 14 and the suction pipe 3 is provided via a channel 53.

Figure 15:
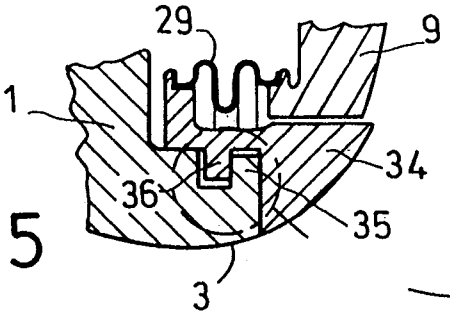
FIG. 15 is a detail view showing one example of a bayonet mounting for a resilient bellows support suitable for use in the embodiment of FIG. 14.
Figure 16:
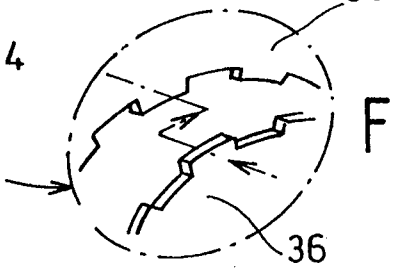
FIG. 16 is an exploded fragmentary perspective view showing how the bayonet system of FIG. 15 is implemented.

FIGS. 15 and 16 show an implementation detail applicable to the embodiments of FIGS. 12 and 14, in which the bellows 29 situated adjacent to the suction pipe 3 is mounted between the intermediate part 9 and an additional part 34 which may be removably fitted on the front portion 1 of the casing by a bayonet type connection 35, 36.

Figure 17:
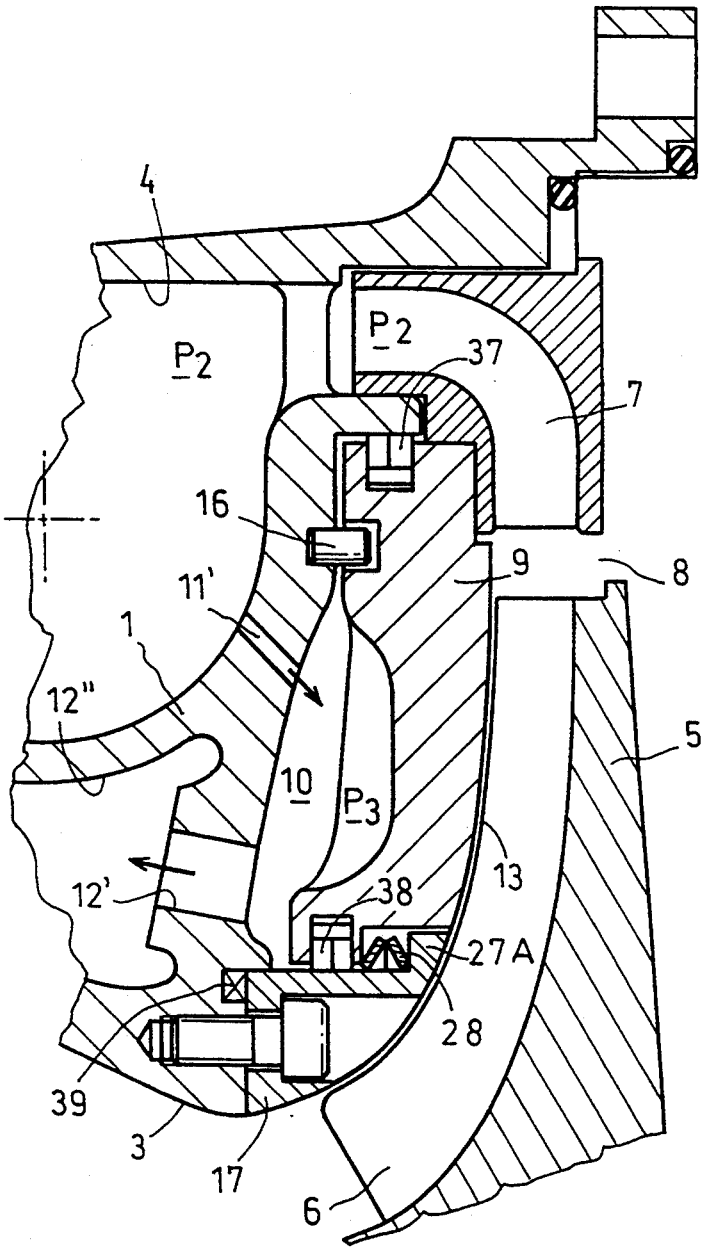
FIG. 17 is an axial half-section view showing a variant of the FIG. 2 embodiment.

FIG. 17 shows a particular embodiment that is very similar to that of FIG. 2 but in which a peg 16 is explicitly shown for preventing a solid piston type intermediate part 9 from rotating relative to the casing 1, 2, with sealing rings 38, 39, and 37 performing the function of the sealing rings 25 and 27 in FIG. 7, and with a spring 28 interposed between a thrust flange 27A and the intermediate part 9.

More particularly, FIG. 17 corresponds to an embodiment in which the back pressure P3 is obtained by taking off pressure via a channel 11' from the fluid in a volute associated with the delivery pipe 4, and fluid is exhausted from the cavity 10 via a channel 12' and a space 12" so that the fluid coming from the diffuser 7 expands and the back pressure P3 inside the cavity 10 can be lower than the delivery pressure P2.

Figure 18:
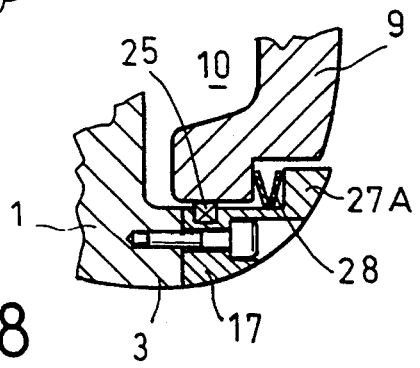
FIG. 18 is a detail view showing the abutment-forming portion of FIG. 17.

FIG. 18 merely shows a variant of the FIG. 17 embodiment in which a single friction seal 25 is interposed between the intermediate part 9 and the part 17 carrying the thrust flange 27A which is secured to the front portion 1 of the casing 1, 2.

In the various embodiments described above, it is assumed that the fluid which exerts the back pressure P3 and which is inserted into the cavity 10 between the portion 1 of the casing 1, 2 and the intermediate part 9 remains at a constant pressure. When the back pressure P3 is equal to the delivery pressure, it suffices for the fluid to flow at a very low rate from the delivery pipe 4 to the suction pipe 3 via the cavity 10. This can be obtained by passage 11, 12 of FIGS. 1 and 4, for example, or by the association of passages 11, 12, and 18, 20 of FIG. 3.

To achieve this very low flow rate, the head losses of the calibrated inlet orifices such as the orifices 11 and 19 in FIG. 3 are generally lower than the head losses of the calibrated outlet orifices such as the orifices 21, 12 in FIG. 3.

In another embodiment shown in FIGS. 19 and 20, the fluid which is taken directly or indirectly from the delivery pipe 4, e.g. via passages 11, 18 analogous to those of the embodiment of FIG. 3, flows at a very low flow rate behind the intermediate part 9 through the cavity 10 to the passages 20, 12 that provide communication with the suction pipe 3, such as to establish a back pressure gradient that is more or less identical to the pressure gradient which exists between the intermediate part 9 and the impeller 5. By way of example, the gradient may run from 150 bar in the delivery pipe 4 to 30 bar in the suction pipe 3.

To achieve this very low flow rate, a series of obstacles is placed between the part 9 and the front portion 1 of the casing 1, 2, which obstacles establish head losses each smaller than the preceding head loss when going from delivery to suction, so that distributed calibration is achieved.

FIG. 19 shows obstacles constituted by porous partitions 41 to 43 creating successively lower pressures P3, P3', P3", P3''' inside the cavity 10. The porous partitions 41 to 43 may be secured to the casing and they may be connected to the intermediate part 9 via U-shaped seals 61 to 63.

FIG. 20 shows obstacles constituted by baffles 44 to 46 that serve likewise to establish progressively lower pressures.

Figure 19A:
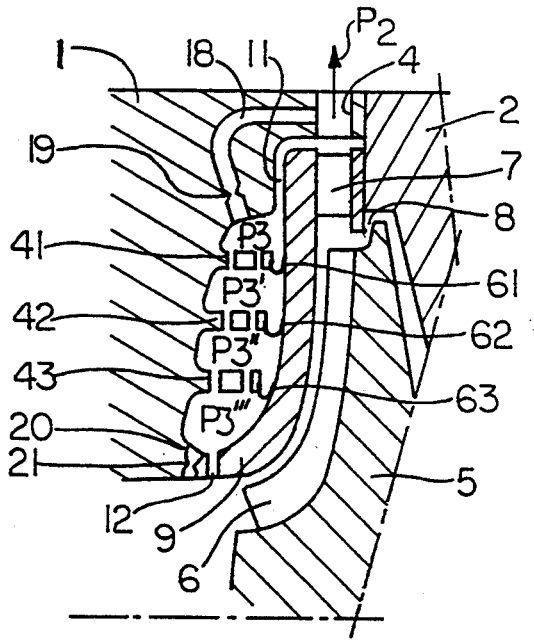

The obstacles may also be partitions provided with a plurality of calibrated orifices, as shown in FIG. 19A.

The porous partitions 41 to 43 of FIG. 19 need not be directly connected to the front portion 1 of the casing 1, 2, and they could, for example, be in the form of flat washers resting via flat gaskets on collars secured respectively to the front outer portion 1 of the casing and to the intermediate part 9.

It is assumed above that the back pressure P3 is less than or equal to the pressure P2 in the delivery pipe 4.

In some cases, it is nevertheless possible for the back pressure P3 to be servo-controlled to the delivery pressure P2 in such a manner as to be greater than the delivery pressure.

Such an embodiment makes it possible to avoid certain modes of vibration, and is particularly applicable to multistage pumps such as that shown diagrammatically in FIG. 22.

FIG. 22 thus shows a two-stage centrifugal pump whose first stage comprises an open-faced impeller 5 which co-operates with an intermediate part 9 of the invention, while the second stage comprises an impeller 5' that is provided with a shroud secured to the impeller 5'. The outlet pressure P4 from the second stage, which is greater than the outlet pressure P2 from the first stage, can be injected behind the intermediate part 9 of the first stage in the form of a pressure P'3 that may be slightly relaxed relative to the pressure P4 while nevertheless remaining greater than the outlet pressure P2 from the first stage.

When the invention is applied to a multistage pump, the second stage may comprise a shrouded impeller as shown in FIG. 22, or it may comprise an open-faced impeller implemented in accordance with the invention as for the first stage.

Numerous variants can be applied to the embodiments described above.

Thus, the diffuser 7 may be radial, axial, or combined, and it may have various configurations in combinations with a volute of the delivery duct 4.

FIG. 21 shows five different configurations associating diffusers 7A to 7E with outlet volutes 4A to 4E.

In general, the back pressure P3 in the cavity 10 is predetermined, is adjusted during the development stage, and is then reproduced accurately by a set of calibrated openings situated where the gas is taken from the outlet volute or from an independent system.

Figure 3A:
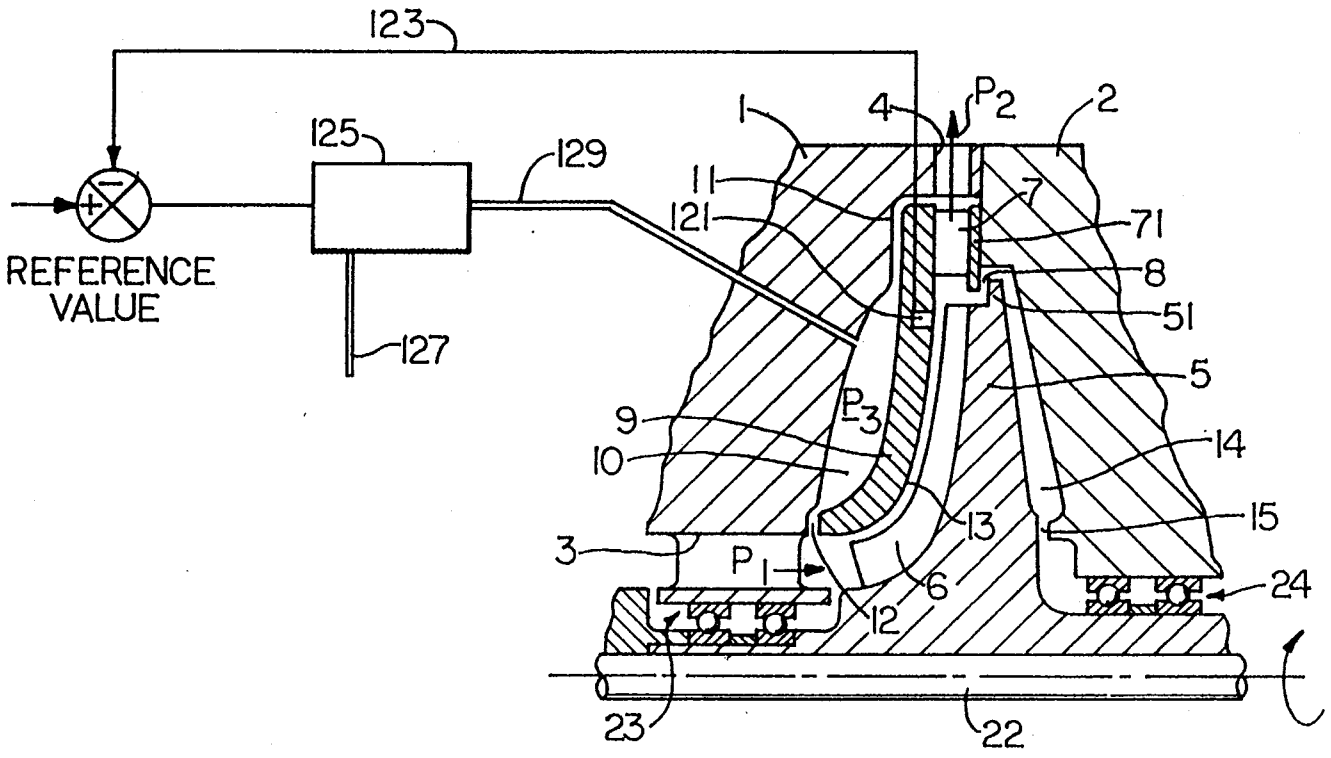
FIG. 3A shows a variant of the FIG. 1 embodiment, further showing servo-control.

In some cases, it is also possible to servo-control the back pressure P3 to the clearance between the impeller 5 and the intermediate part 9, said clearance itself being monitored by a proximity sensor 121 in electrical communication via line 123 to servo-controller 125, as shown in FIG. 3A. The pressure is controlled by fluid fed to the servo-controller via fluid line 127 and to the cavity 10 via fluid line 129.

As a variant of the embodiments of FIGS. 3 and 14, it is also possible to make the intermediate part 9 act as the support for the front bearing 23.

The invention is applicable to centrifugal pumps usable under a very wide range of conditions of use.

For example, the invention may be implemented in a turbopump having a single stage that presents a delivery pressure of 250 bar, at a flow rate of 100 kg/s, providing axial thrust of 100 metric tons and a peripheral impeller speed of 640 meters per second (m/s).

We claim:

1. A centrifugal pump having an axis and comprising at least one open-faced impeller conveying a working liquid, said at least one open-faced impeller fitted with blades placed inside a casing defining a suction pipe facing a base of the blades situated proximate to a central shaft for driving said at least one open-faced impeller and forming a portion of a rotary assembly, and a delivery pipe fitted with a fixed diffuser disposed facing peripheral ends of the blades, said centrifugal pump further comprising:

a) an active axial balancing system for the rotary assembly, which balancing system is integrated in said at least one open-faced impeller and comprises a balancing chamber interposed between a rear face of said at least one open-faced impeller and an outer rear portion of the casing, said balancing chamber communicating with said delivery pipe via a first nozzle whose axial clearance is maintained so as to be unvarying in operation and which is defined by a peripheral end of said at least one open-faced impeller, said impeller acting as a balancing turntable, and a nozzle piece secured to said outer rear portion of the casing and interposed between said fixed diffuser and said peripheral end of said at least one open-faced impeller, said balancing chamber communicating with the suction pipe of the pump via a second nozzle, and b) a shroud-forming intermediate part prevented from rotating relative to the casing, interposed between an outer front portion of the casing and said at least one open-faced impeller, a portion of said shroud-forming intermediate part facing the blades of said at least one open-faced impeller and having a certain capacity for displacement and having a certain capacity for deformation in a direction parallel to the axis of the pump, a cavity being provided between said outer front portion of the casing and said intermediate part to receive a back pressure of predetermined value enabling small clearance without contact to be maintained in operation between said intermediate part that is prevented from rotating and the blades of said at least one open-faced impeller that is rotated, regardless of any deformations of the outer front portion of the casing.

2. A centrifugal pump according to claim 1, including means enabling a small flow of liquid to circulate through said cavity, from the delivery pipe to the suction pipe.

3. A centrifugal pump according to claim 1, wherein a clearance J between said at least one open-faced impeller and the shroud forming intermediate part is determined by a sequence of design dimensions limited to a combination of a design dimension J1 defined between said nozzle piece and a wall of the intermediate part facing the blades, a design dimension J12 defined between said nozzle piece and the peripheral end of said at least one open-faced impeller, and a design dimension J13 defined between said peripheral end of said at least one open-faced impeller and a front face of said at least one open-faced impeller.

4. A centrifugal pump according to claim 1, including means for applying said back pressure in the cavity by an additional liquid different from the working liquid conveyed by the pump, but of a chemical composition that is compatible with that of the working liquid.

5. A centrifugal pump according to claim 1, including means for applying said back pressure in the cavity by means of the working fluid conveyed by the pump.

6. A centrifugal pump according to claim 1, including a specific circuit passing through the casing to feed the cavity with liquid for the purpose of exerting said back pressure.

7. A centrifugal pump according to claim 1, comprising a plurality of pumping stages and wherein at least one pumping stage comprises said at least one open-faced impeller integrating said active axial balancing system and co-operating with said shroud-forming intermediate part that is prevented from rotating relative to the casing.

8. A centrifugal pump according to claim 7, further comprising means for applying said back pressure in the cavity comprising means for taking working liquid from a pumping stage situated downstream from said at least one pumping stage that includes said at least one open-faced impeller and reinjection means for injecting the working liquid as taken into the cavity.

9. A centrifugal pump according to claim 5, wherein the means for applying said back pressure in the cavity comprise means for communicating fluid between the delivery pipe and the suction pipe.

10. A centrifugal pump according to claim 1, wherein the back pressure exerted in the cavity is servo-controlled to the clearance of the impeller, said clearance being monitored by a proximity sensor.

11. A centrifugal pump according to claim 1, wherein the cavity situated between the outer front portion of the casing and the intermediate part includes a series of obstacles creating head losses, such that fluid taken from the delivery pipe flows behind the intermediate part towards the suction pipe at a very low flow rate and with a back pressure gradient similar to a pressure gradient that exists between the intermediate part and said at least one open-faced impeller between the delivery pipe and the suction pipe.

12. A centrifugal pump according to claim 11, wherein the obstacles creating head losses in the cavity are constituted by porous partitions.

13. A centrifugal pump according to claim 11, wherein said obstacles creating head losses in the cavity are constituted by baffles.

14. A centrifugal pump according to claim 11, wherein said obstacles creating head losses in the cavity are constituted by partitions provided with a plurality of calibrated orifices.

15. A centrifugal pump according to claim 1, wherein a fluid is inserted into the cavity situated between the front portion of the casing and the intermediate part in such a manner as to exert back pressure of a value that is substantially constant on the entire intermediate part.

16. A centrifugal pump according to claim 15, wherein the intermediate part is flexible with predetermined stiffness and is rigidly fixed to the casing in the vicinity of the suction pipe and also in the vicinity of the delivery pipe.

17. A centrifugal pump according to claim 15, wherein the intermediate part is semi-rigid and is mounted so as to be free relative to the casing in the vicinity of the suction pipe, with a sealing gasket being interposed between said intermediate part and said casing in the vicinity of said suction pipe.

18. A centrifugal pump according to claim 16, wherein the intermediate part and the fixed diffuser are constituted by a single piece.

19. A centrifugal pump according to claim 16, wherein the intermediate part is fixed directly to the fixed diffuser and the fixed diffuser is mounted in a stationary manner on the casing.

20. A centrifugal pump according to claim 15, wherein the intermediate part is constituted by a rigid piece mounted in such a manner as to be capable of moving slightly relative to the outer front portion of the casing under the effect of the back pressure applied in the cavity while being prevented from rotating relative to said outer front portion of the casing, sealing gaskets being interposed between said intermediate part and the casing in the vicinity of the suction pipe and of the delivery pipe.

21. A centrifugal pump according to claim 20, including a resilient bellows of predetermined stiffness interposed between the outer front portion of the casing and the intermediate part in the vicinity of the delivery pipe to provide sealing between the outer front portion of the casing and the intermediate part and to exert a thrust force on the intermediate part towards the diffuser.

22. A centrifugal pump according to claim 20, including a rubbing sealing gasket between the front portion of the casing and the intermediate part in the vicinity of the delivery pipe.

23. A centrifugal pump according to claim 22, wherein the intermediate part is held pressed against the fixed diffuser under drive from a spring, and under drive from the back pressure applied in said cavity.

24. A centrifugal pump according to claim 17, including a resilient bellows of predetermined stiffness interposed between the outer front portion of the casing and the intermediate part in the vicinity of the suction pipe to provide sealing and to hold the intermediate part off the at least one open-faced impeller when at rest.

25. A centrifugal pump according to claim 17, including a spring of predetermined stiffness interposed between the intermediate part and the casing, in the vicinity of the suction pipe, in order to keep the intermediate part off the at least one open-faced impeller at rest.

26. A centrifugal pump according to claim 25, wherein said spring comprises a set of "Belleville" spring washers.

27. A centrifugal pump according to claim 25, wherein said spring comprises a ribbed washer.

28. A centrifugal pump according to claim 8, wherein the back pressure is greater than the pressure exerted by the at least one open-faced impeller in said at least one pumping stage, and wherein said intermediate part cooperates with an abutment secured to the outer front portion of the casing which limits the stroke of the intermediate part towards the at least one open-faced impeller in the vicinity of the suction pipe.

29. A centrifugal pump according to claim 1, wherein said centrifugal pump is applied to a high power turbopump for a rocket engine.

* * * * *